United States Patent [19]

Sbragi

[11] Patent Number: 5,033,168

[45] Date of Patent: Jul. 23, 1991

[54] BUTTON COVER WITH SLIDABLE FASTENING MEMBER

[76] Inventor: Luca Sbragi, 18, Via della Fiorandola, Arezzo, Italy

[21] Appl. No.: 599,560

[22] Filed: Oct. 18, 1990

[30] Foreign Application Priority Data

Nov. 6, 1989 [IT] Italy ..... 11734/89[U]

[51] Int. Cl.[5] ..... A44B 1/14

[52] U.S. Cl. ..... 24/113 MP; 24/90 A

[58] Field of Search ..... 24/90.5, 90 A, 113 R, 24/113 MP

[56] References Cited

U.S. PATENT DOCUMENTS 346,649 8/1886 Fox ..... 24/113 R

FOREIGN PATENT DOCUMENTS 145257 9/1902 Fed. Rep. of Germany ..... 24/113 MP 2211345 9/1973 Fed. Rep. of Germany ..... 24/113 MP 2546727 12/1984 France ..... 24/90 A 4213 of 1893 United Kingdom ..... 24/113 MP

*Primary Examiner*—James R. Brittain

*Attorney, Agent, or Firm*—Browdy and Neimark

[57] ABSTRACT

A button cover, in particular for shirt cuff buttons, comprising a covering member (2) and a fastening support integral to it. The fastening support comprises a circular edge (7) extending from a face of the covering member and having a semiannular projection (8) inwardly extending from said edge. An annular member (3) is axially connected to the edge for sliding in a circumferential direction and has an internal diameter equal to the external diameter of the edge. The annular member is provided with an inwardly extending semiannular projection (10) and blocking elements (8*a*, 10*a*) are provided for preventing any rotation of the annular member (3) with respect to the edge (7) when a button has been entered and secured within the edge.

4 Claims, 1 Drawing Sheet

BUTTON COVER WITH SLIDABLE FASTENING MEMBER

DESCRIPTION

1. Field of the Invention

The present invention relates to a button cover for use, in particular, as an ornament on male shirts as it can be applied over ordinary shirt cuff buttons to simulate the appearance of cuff links.

2. Background Art

A button cover consists usually of an ornamental covering portion, known in a large number of shapes and designs, fixable to the button by means of a support member, generally comprising a pair of elastic clamping arms with rounded, constantly contacting ends, through which the button thread is forced to pass so as to block the thread between the arms. A fastening support of this type has the disadvantage that said clamping arms become loose with the use thus causing the release of the thread; in this way the button cover can disengage from the button casually and get lost.

Another type of button cover has a fastening device comprising an edge extending from one face of the ornamental covering portion so as to house the button: a part of the edge is integral with the covering portion, while the remaining part is hinged to it and can be secured the fixed part of the edge by means of an elastic tooth or hook so as to keep the button therein. In this case too the elastic tooth or hook may not assure good fastening conditions with the use, this resulting in the risk of loosing the button cover.

It is the main object of the present invention to provide a button cover suitable of being easily applied over a button, for example a cuff shirt button, with no risk of being accidentally released.

SUMMARY OF THE INVENTION

The main feature of the button cover according to the present invention consists in that it can be secured to the button by means of a support comprising a circular edge having an inwardly extending semiannular projection and an annular member, substantially equal and coaxial to said edge, having internal diameter substantially equal to the external diameter of said circular edge. The annular member has an inwardly extending semiannular projection and is engaged around said circular edge for sliding in a circumferential direction on it. Blocking means are provided on both semiannular projections in particular comprising a step and a correspondingly shaped seat formed on their end portions. By rotating the annular member about the edge up to an open position wherein the semiannular projections are superposed, a button can be entered between the ornamental covering portion and the superposed semiannular projections, while by one half turn of the annular member in the opposite direction the button cover is placed in its closed position, wherein the step elastically engages with the corresponding seat thus blocking any further rotation of the annular member. In this way the button cover cannot disengage accidentally from the button.

In order to allow the sliding of the annular member about the edge of the covering portion without the annular member being disengaged from the edge, the sliding surfaces are preferably of toric shape.

Further characteristics and advantages of the button cover according to the invention will be apparent from the following, not limiting and exemplifying description made with reference to the attached drawings.

DESCRIPTION OF A PREFERRED EMBODIMENT

Figure 1:
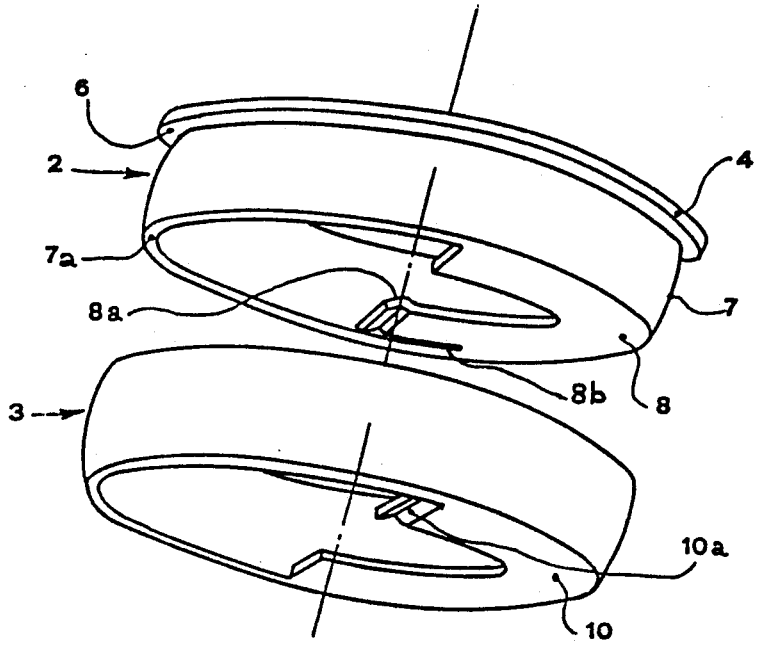
FIG. 1 is an exploded perspective view of the button cover according to the invention.

With reference to the above referenced figures, a button cover 1 according to the present invention is formed by a hollow cap 2 and an annular member or ring 3 made of precious or not precious material. Cap 2 comprises a covering member 4 having a convex face 5, which any desired ornamental design can be applied to or formed on, and a concave face 6 from which there extends a circular edge 7 having a substantially torus-shaped or convex profile. A semiannular projection 8 extending inwardly is formed on the free end 7*a* of edge 7.

Annular member 3 has a profile substantially equal to that of edge 7 and a rated internal diameter equal to the external diameter of edge 7. A semiannular projection 10, equal to the projection 8 of edge 7 extends inwardly from annular member 3.

Annular member 3 is engaged with edge 7 so as to slide on the external surface thereof. The convex shape of the sliding surfaces of annular member 3 and edge 7 prevent their mutual movements in the axial direction, while allowing them to slide in the circumferential direction. In correspondence with an end portion of semiannular projection 10 a step 10*a* is formed, for example by punching, while a correspondingly shaped seat 8*a* is formed on the end portion of the other semiannular projection 8. A cut 8*b* is furthermore provided for a short lenght between edge 7 and semiannular projection 8 near seat 8*a*.

Figure 2:
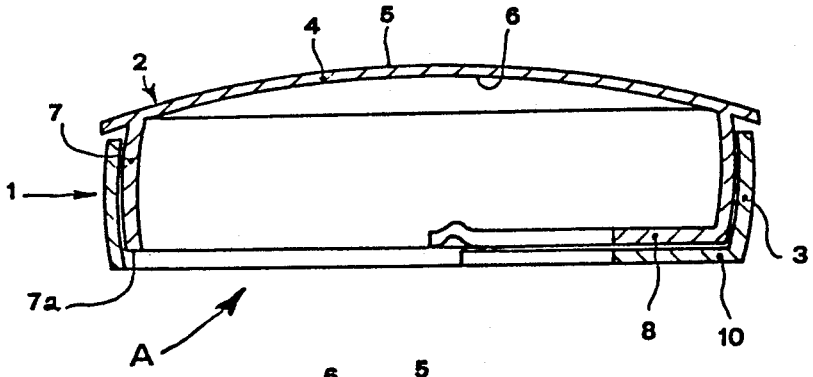
FIG. 2 is a cross sectional view of the button cover according to the invention in a open position.

On applying the button cover 1 according to the invention to a shirt button, for example a cuff button, the annular member 3 is rotated about edge 7 to bring the semiannular projection 10 into correspondence to the relevant semiannular projection 8 in a superposed condition. When the button cover is placed in the above described "open" position, shown in FIG. 2, step 10*a* abuts against the free end of semiannular projection 8 opposite to that where seat 8*a* is formed. The shirt button can be inserted within the button cover, when the latter is in its open position, according to arrow A in FIG. 2.

Figure 3:
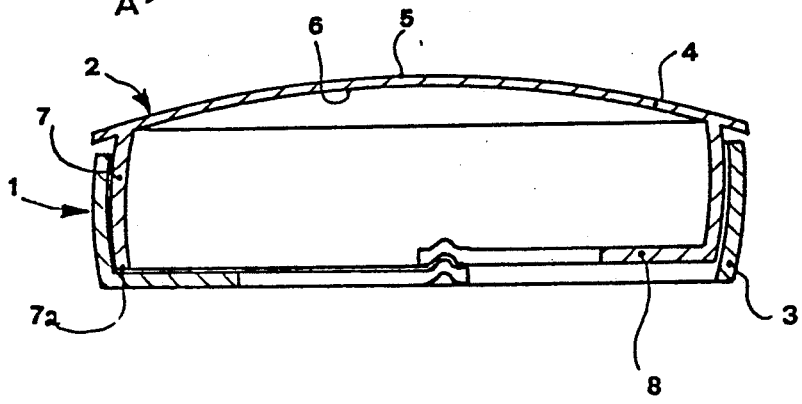
FIG. 3 is a cross sectional view of the button cover according to the invention in a closed position.

In order to secure a shirt button in the interior of button cover 1, starting from the above described open position, annular member 3 is rotated half-turn about edge 7 to reach a "closed" position shown in FIG. 3. In the closed position the button is locked in the button cover 1 as step 10*a* and seat 8*a* are mutually engaged, the engaging operation being made easier by virtue of the flexibility of the end portion of semiannular projection 8 due to cut 8*b*. The internal radius of edge 7 is greater than the radius of the buttons commonly used for shirts, while the internal radius of semiannular projections 8 and 10 is lower than the button radius so that the button housed in the button cover cannot escape therefrom. Preferably, edge 7 is fixed to the covering member 4 by soldering.

It has to be pointed out that covering member 4, which is the ornamental part of the button cover 1, can be made according to many different shapes, such as circular, square, hexagonal and any other one, and every shape can exhibit a different ornamental feature.

The button cover according to the invention, as described above, can be easily applied to a shirt button from which cannot accidentally disengage.

The external surface of edge 7 and annular member 3 have been made with convex or torus-shaped profile, so as to prevent them being disengaged from one another. It is obvious, however, that the same result can be obtained by providing these surfaces with a frusto-conical profile or with circumferential guide means or any other equivalent device for allowing the sliding of annular member 3 about edge 7 while avoiding its disengagement.

While the invention has been described in detail above, it is to be understood that this detailed description is by way of example only, and variations and modifications can be brought without departing from the scope of the invention itself.

What is claimed is:

1. A button cover, especially for shirt cuff buttons, comprising:

a covering member (2) having an ornamental face (5); a circular edge (7) extending from a face (6) of said covering member opposite to said ornamental face (5) and having a semiannular projection (8) inwardly extending from said edge (7);

an annular member (3) coaxially connected to said edge (7) for sliding in a circumferential direction, said annular member (3) having an internal diameter equal to the external diameter of said edge (7) and being provided with an inwardly extending semiannular projection (10);

blocking means (8*a*, 10*a*) provided on both said semiannular projections (8, 10) for preventing any rotation of the annular member (3) with respect to the edge (7) when a button has been inserted within the edge.

2. A button cover according to claim 1, wherein said annular member (3) and said edge (7) have torus-shaped or convex sliding surfaces so as to avoid the annular member being disconnected from said edge, while allowing the mutual sliding.

3. A button cover according to the claim 1, wherein said rotation blocking means comprises a step (10*a*) formed on an end portion of the semiannular projection (10) of said member (3) and a correspondingly shaped seat (8*a*) formed on an end portion of the semiannular projection (8*a*) said edge (7), whereby the button cover may be placed in an open position suitable for entering the button, wherein said semiannular projections (8, 10) are superposed, and a closed position obtained by rotating half turn said annular member (3), wherein said step (10) is engaged with said seat (8*a*).

4. A button cover according to claim 3, wherein a cut (8*b*) is formed between said edge (7) and the end portion of said semiannular projection of said edge in correspondence of said seat (8*a*).

* * * * *